US005524458A

United States Patent [19]

Buchner

[11] Patent Number: 5,524,458

[45] Date of Patent: Jun. 11, 1996

[54] JEWELRY

[76] Inventor: Michaela Buchner, Amalienstrasse 87, D-80799 Munchen, Germany

[21] Appl. No.: 277,085

[22] Filed: Jul. 19, 1994

[51] Int. Cl.[6] ..... A44C 17/02

[52] U.S. Cl. ..... 63/28

[58] Field of Search ..... 63/26, 28, 29.1, 63/30, 31

[56] References Cited

U.S. PATENT DOCUMENTS

| | | | |
|---|---|---|---|
| 1,442,815 | 1/1923 | Maker et al. | 63/28 |
| 1,799,187 | 4/1931 | Wander | 63/28 |
| 1,927,221 | 9/1933 | Schnarr | 63/26 |
| 2,056,705 | 10/1936 | Arpels | 63/29.1 |
| 2,058,978 | 10/1936 | Hamin | 63/26 |
| 2,519,152 | 8/1950 | Piotrowski . | |
| 4,292,818 | 10/1981 | Vitau . | |
| 4,374,470 | 2/1983 | Isaacson | 63/29.1 |
| 4,742,696 | 5/1988 | Jenkins | 63/29.1 |
| 5,022,238 | 6/1991 | German | 63/26 |
| 5,339,655 | 8/1994 | Grando | 63/26 |

FOREIGN PATENT DOCUMENTS

| | | | |
|---|---|---|---|
| 667758 | 12/1929 | France | 63/26 |
| 1736339 | 12/1956 | Germany . | |
| 1066788 | 10/1959 | Germany . | |
| 3034164 | 4/1981 | Germany . | |
| 3816665 | 12/1988 | Germany . | |
| 3931109 | 3/1991 | Germany . | |
| 9307751 | 9/1993 | Germany . | |

*Primary Examiner*—Michael J. Milano
*Attorney, Agent, or Firm*—Burns, Doane, Swecker & Mathis

[57] ABSTRACT

Briefly summarized, the invention provides a piece of jewelry which comprises at least the following:

a) a first jewelry section, which exhibits receiving openings for the loose setting of gemstones or beads; and b) a second jewelry section, which can be mounted detachably on the first section of jewelry and exhibits viewing openings, where the receiving openings of the first section of jewelry and the viewing openings of the second section of jewelry are designed in such a manner that in the assembled state of the jewelry sections, in which the second section of jewelry is mounted detachably on the first section of jewelry, (1) gemstones or beads, set into the receiving openings of the first section of jewelry, are visible through the viewing openings of the second section of the piece of jewelry; and (2) at least one portion of the border of the viewing openings of the second jewelry section rests on one of the gemstones or one of the beads and holds said gemstone or bead in the respective receiving opening in the first jewelry section, wherein (A) all or a portion of the borders of the viewing openings are designed as a lattice-shaped jewelry pattern; and (B) for one and same piece of jewelry (1) either all or a portion of the borders of the viewing openings rest by choice on side edges of the gemstones or beads located directly underneath, (2) or all or a portion of the webs of the lattice-shaped jewelry pattern, which is located between the laterally adjacent viewing openings, rest by choice on the central regions of the gemstones or beads located directly underneath.

13 Claims, 4 Drawing Sheets

JEWELRY

BACKGROUND OF THE INVENTION

The invention relates to jewelry with set gemstones and/or beads.

There exist a plurality of different kinds of jewelry such as rings, ear rings, brooches, bracelets, diadems or the like, in which gemstones and/or beads are set. The production of such jewelry is in general time-consuming and requires above all, especially if a number of gemstones and/or beads are to be set in a single piece of jewelry, an especially time-consuming single production of the respective piece of jewelry, so that not only the material costs but also the actual production costs are high.

The object of the present invention is to provide in particular jewelry with set gemstones and/or beads, whose production costs for various possible choices and variations with respect to the gemstones and/or beads that are used are relatively low and that can, nevertheless, be produced in the most precious embodiments down to inexpensive, but also quite aesthetic embodiments.

SUMMARY OF A PREFERRED EMBODIMENT OF THE INVENTION

This problem is solved, according to the invention, by means of a piece of jewelry that comprises the following:

a) a first section of jewelry exhibiting receiving openings for the loose setting of gemstones or beads; and b) a second section of jewelry, which can be mounted detachably on the first section of jewelry and exhibits viewing openings, where the receiving openings of the first section of jewelry and the viewing openings of the second section of jewelry are designed in such a manner that in the assembled state of the jewelry sections, in which the second section of jewelry is mounted detachably on the first section of jewelry, (1) gemstones or beads set into the receiving openings of the first section of jewelry are visible through the viewing openings of the second section of the piece of jewelry; and (2) at least one portion of the border of the viewing openings of the second section of the piece of jewelry rests on one of the gemstones or one of the beads and holds said gemstone or bead in the respective receiving opening in the first section of the piece of jewelry, where (A) all or a portion of the borders of the viewing openings are designed as a lattice-shaped jewelry pattern; and (B) for one and same piece of jewelry (1) either all or a portion of the borders of the viewing openings rest by choice on side edges of the gemstones or beads located directly underneath, (2) or all or a portion of the webs of the lattice-shaped jewelry pattern, which is located between the laterally adjacent viewing openings, rest by choice on the central regions of the gemstones or beads located directly underneath.

The latter kind of relative configuration between borders and gemstones and/or beads can be aesthetically very attractive, especially for gemstones.

Such jewelry can be produced—and that applies not only to the above basic embodiment but also to the other engineered embodiments listed below—in such a manner that the actual production costs, i.e. thus without any consideration of the material costs, are relatively low, because, for example, the aforementioned jewelry is produced on computer-controlled material processing machines, where the assembly costs for joining jewelry sections and gemstones and/or beads, are relatively low compared to the conventional jewelry of suitable scope. Nevertheless, a number of different pieces of jewelry can be produced with the same jewelry sections by selecting different configurations and kinds of gemstones and/or beads and different combinations of different kinds of gemstones and/or beads.

Even the same geometrical shape of the aforementioned jewelry sections themselves can be designed with different materials, e.g. precious metals or precious metal alloys, but also from non-precious metals or alloys, which are preferably gold-plated or silver-plated or platinum-plated.

Another improvement of the aforementioned basic embodiment of the jewelry according to the invention, with which even more diverse shapes of jewelry can be obtained, is characterized in that (a) the second jewelry section exhibits, besides viewing openings, receiving openings for the loose setting of additional gemstones or beads; and (b) a third jewelry section is provided that can be mounted detachably on the second jewelry section and that exhibits viewing openings;

where in the assembled state, in which the third jewelry section is mounted detachably on the second jewelry section, (1) gemstones or beads set into the receiving openings of the second jewelry section are visible through the viewing openings of the third jewelry section;

(2) at least one portion of the border of the viewing openings of the third jewelry section rests on one of the additional gemstones or one of the additional beads and holds said gemstone or bead in the respective receiving opening;

and where in the detachably assembled state of all of the jewelry sections the third jewelry section allows the viewing openings of the first jewelry section to remain exposed on the outside.

This embodiment makes it possible to design jewelry with at least two different regions set with gemstones and/or beads, thus resulting in a larger diversity of possible configurations and designs.

Virtually any engineered shape of jewelry can be obtained from the almost unlimited diversity of configurations and designs with an improvement of the jewelry, which exhibits the invention and builds on the latter embodiment of the invention and which is characterized in that several jewelry sections, each of which exhibits both receiving openings for the loose setting of additional gemstones or beads and also viewing openings, are stacked between the first and third jewelry section; where the first jewelry section, the second jewelry sections and the third jewelry section can be connected together detachably; and in the assembled state of the jewelry sections, in which the first jewelry section, the second jewelry sections and the third jewelry section are connected together detachably, (a) the gemstones or beads set into the receiving openings of each of the jewelry sections are visible through the viewing openings of the jewelry section, mounted, in particular directly, above;

(b) at least one portion of the border of the viewing openings of each jewelry section provided with the same rests on one of the gemstones or one of the beads, which are set into the receiving openings of a jewelry section arranged directly underneath, and thus holds said gemstone or bead in the respective receiving opening; and (c) all viewing openings are visible from the outside.

This embodiment of the invention makes it possible to obtain jewelry with any desired number of identically or differently shaped jewelry regions with gemstone and/or bead settings, whereby the number of jewelry regions is limited in essence only by the space available for the respective jewelry, and whereby within the space that the jewelry occupies the maximum density of gemstones and/or beads can be concentrated in a manner that is aesthetically highly attractive.

For maximum and optimal utilization of the space available for the jewelry with respect to the embodiment of the jewelry according to the invention, in which more than two jewelry sections of the aforementioned kind are stacked and connected detachably together, the jewelry according to the invention can be designed in such a manner in these cases that some or all receiving openings are passage openings, and that there are free space openings in the regions of the jewelry sections, which are situated in the assembled state of the jewelry directly below such a passage opening; and that the rear sides of the gemstones or beads held in these passage openings are arranged so as to be exposed above or in said free space openings, so that the said jewelry sections can be made thin and stacked densely, without hindering this design on account of a thickness of the gemstones that is necessary for reasons relating to the polishing.

Thus a higher and aesthetically more efficient concentration of the gemstones and beads than that of the invention is hardly conceivable.

Such a concentration and high efficiency of gemstones and/or beads is also made possible in that according to the invention all or a portion of the borders of the viewing openings are designed as a lattice-shaped jewelry pattern, so that adjacent gemstones and/or beads are separated for the observer only by means of webs of the lattice-shaped jewelry pattern, which can be designed very thin.

A preferred embodiment of the invention is characterized in that the individiual jewelry sections are designed as concave parts, whose concavity faces the interior of the piece of jewelry, whereby it is especially preferred that the individual jewelry sections are designed into concave shells, which can be both rounded, such as spherical shells or calottes and ellipsoid shells or calottes, and rectangular or rounded-rectangular, such as square shells, and can also exhibit rounded and/or rectangular and/or flat regions.

In so doing, it is especially preferred that the concavity of the jewelry sections and the size and configuration of the gemstones or beads be coordinated in such a manner that no gemstones project beyond the actual basal plane of the jewelry, i.e. beyond the rear side of the piece of jewelry.

One embodiment of the piece of jewelry that exhibits the invention and is especially interesting with respect to its shape and is suitable not only for jewelry along the line of a brooch is designed in such a manner that the individual jewelry sections designed as concave shells have the shape of conical or pyramidal disks, and in the assembled state form a conical, truncated, pyramidal, or truncated pyramidal piece of jewelry, whereby preferably the angle between the central axis of the cone or pyramid and the conical and pyramidal areas of the piece of jewelry is selected in such a manner in accordance with the size and configuration of the gemstones or beads that no gemstones or beads project outwardly beyond the actual basal plane of the piece of jewelry.

To fasten together detachably the jewelry sections, various known detachable connections are suitable, so that here as only one example of such a detachable connection is cited a screw-nut connection, with which the jewelry sections can be fastened together. Such an element of the detachable connection that is visible to the observer of the assembled and worn jewelry, can be designed as a decorative element of the piece of jewelry, so that thus in the above example the screw and/or the nut of the screw-nut connection is designed at least partially as a decorative element of the jewelry. This decorative element is then designed preferably in such a manner that it forms for the observer an integral component of the entire piece of jewelry, in particular an uppermost element that is concave toward the interior of the jewelry, such as a concave shell, whose shape matches that of the other concave elements, thus e.g. a concave disk for a pyramidal piece of jewelry.

The jewelry sections, provided with receiving openings and/or viewing openings, and also the aforementioned "decorative element" are preferably coated with precious metal or precious metal alloy or made wholly or partially of precious metal or precious metal alloy, even though basically various other materials can also be used, such as non-precious metals, ivory, ornamental wood, ceramic, in particular porcelain, real shell and other organic substances, simple and high-quality plastics or the like.

Suitable gemstones are in particular precious stones, like diamond, saphire, emerald, tourmaline, hematite, jade and the like and also gemstones made of other minerals and other non-precious materials. The gemstones can also be made, however, of non-mineral materials such as amber, glass, ceramic or plastic. In addition, they do not have to be necessarily square, but can have different shapes and exhibit sharp and/or rounded edges and/or corners and also have facets. By "beads" are understood here not only oriental pearls, cultured pearls, shell beads and other beads made of mother-of-pearl or conventional jewelry beads, but all possible bead-shaped materials, like precious stone beads such as jade beads, hematite beads, coral beads, amber beads, ivory beads, metal beads, glass beads, ceramic beads, plastic beads, and the like. The beads do not have to be absolutely spherical, but can also have other rounded shapes, like tear-shaped, oval or the like.

The invention with respect to the entire configuration of the piece of jewelry can be implemented in various ways, without thus limiting the basic idea, so that here only brooches, bracelets arm loops, head or hair jewelry, in particular diadems, rings, pendants, in particular pendants for necklaces or ear jewelry are cited that can be designed wholly or partially as jewelry articles according to the invention.

Preferably the surface area of the individually stacked, aforementioned jewelry increases step-by-step, in particular the diameter increases step-by-step, as apparent from the other embodiments described below.

It is evident from the above explanation that not only the jewelry articles of jewelry, which exhibits the invention and is made of identical jewelry sections, can be produced as a diversity of aesthetically similar and/or highly different jewelry articles by using different gemstones and/or beads and different configurations of the same in the individual sections, but one and the same jewelry article can be modified repeatedly by the user, following purchase, according to her taste for different occasions by offering additional different kinds of gemstones and/or beads.

BRIEF DESCRIPTION OF THE DRAWINGS

The above and other advantages and features of the invention are described and explained in detail in the following with reference to some especially preferred embodiments of jewelry articles, which exhibit the invention and are depicted in FIG. 1 to 6 of the drawing.

DETAILED DESCRIPTION OF THE PREFERRED EMBODIMENTS OF THE INVENTION

Figure 1:
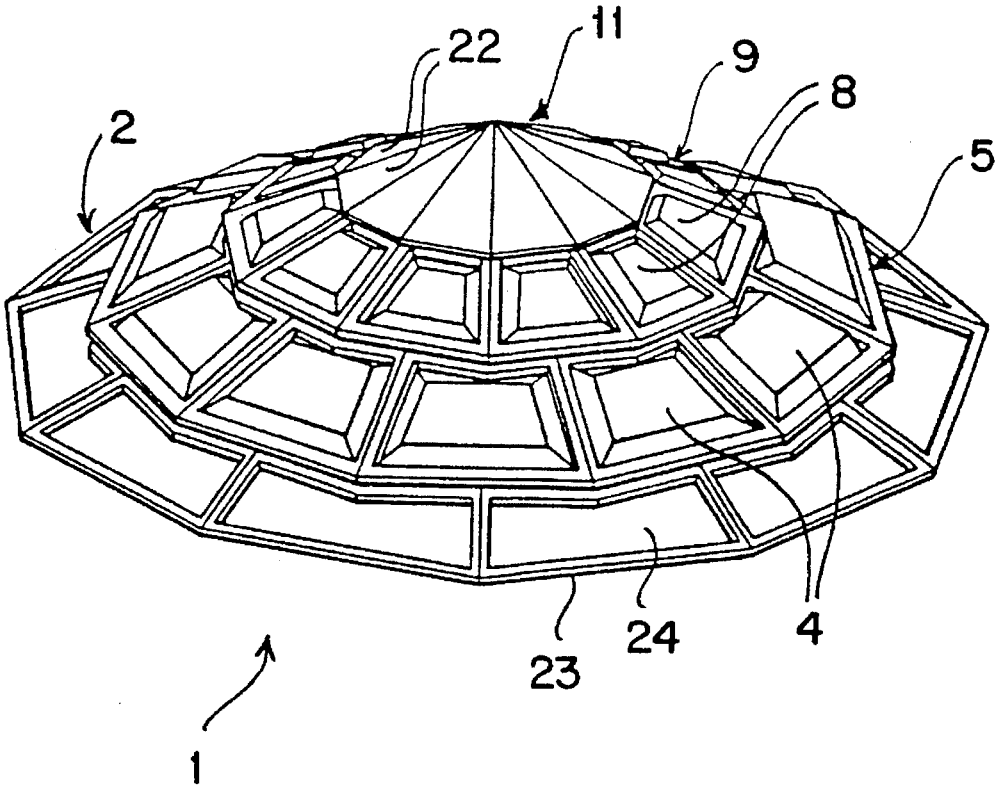
FIG. 1 is a perspective view of a first embodiment of a piece of jewelry according to the invention, which, depending on the size of the design, can be used, for example, as a brooch, necklace pendant, ear pendant, mounting on an arm loop or, in the case of an especially smaller design, also as a mounting on a finger ring.

First of all, one embodiment of a piece of jewelry according to the invention is described in the following with reference to FIGS. 1 to 3 and 5.

Figure 5:
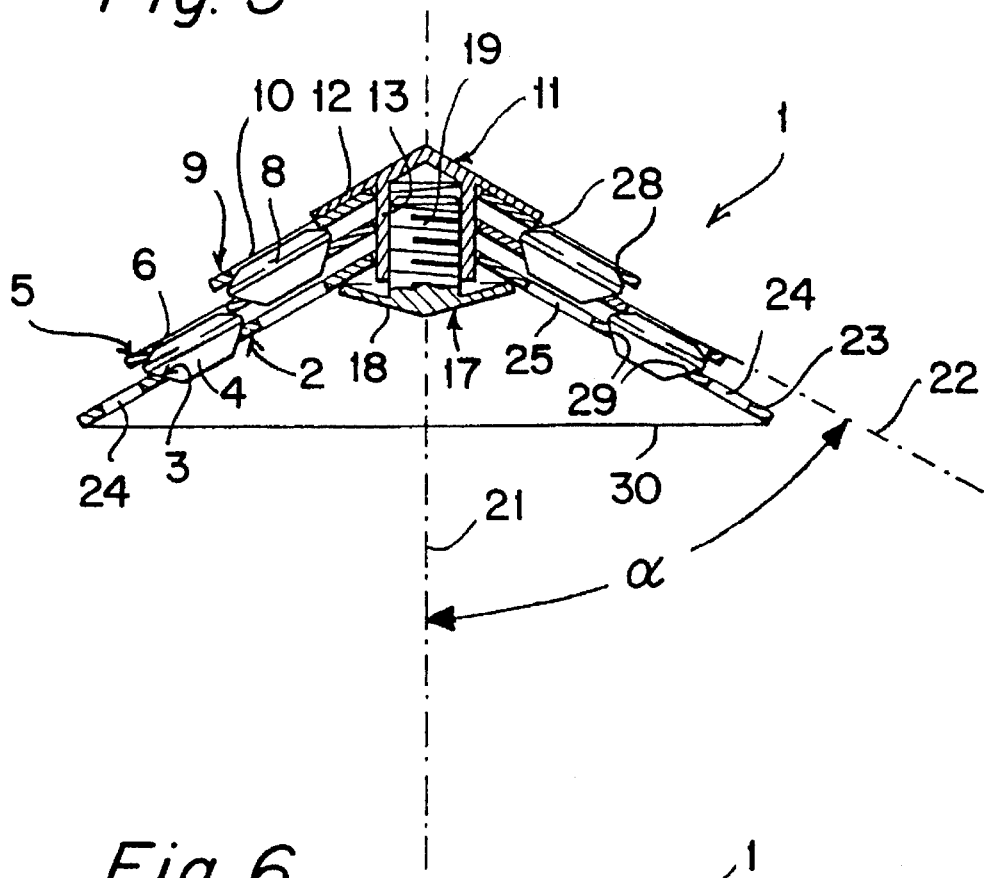
FIG. 5 is a sectional view along line V—V of the state of the piece of jewelry according to FIG. 3.
Figure 6:
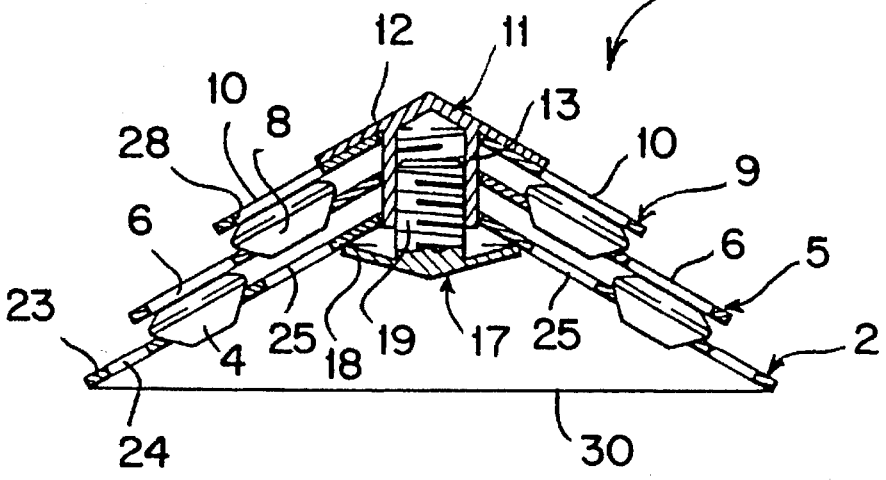
FIG. 6 is a sectional view along line VI—VI of the state of the piece of jewelry according to FIG. 4.

The jewelry, which is depicted in the aforementioned figures and is denoted in its entirety as 1, comprises—apart from non-illustrated pin-on, connecting or other fastening elements for direct or indirect fastening of the same to clothing or the body of a wearer—the following major elements:

(a) a first jewelry section 2, which has receiving openings 3, which are designed in such a manner in the present design that they are suitable for the loose setting of gemstones 4, of which, however, all or a portion can be designed in such a manner that they are suitable for holding beads, in which case they are designed preferably circular, instead of, as shown, rectangular, in particular trapezoid;

(b) a second jewelry section 5, which is mounted detachably on the first jewelry section 2 and exhibits viewing openings 6, and has also receiving openings 7, which are designed in the present design for the loose setting of gemstones 8, but of which all or a portion can also be designed for the suitable holding of beads;

(c) a third jewelry section 9, which is mounted detachably on the second jewelry section 5 and exhibits viewing openings 10;

(d) a nut 11, which exhibits a hat 12, designed as a decorative, integral part of the jewelry article 1 and whose actual nut member 13 can be inserted through the central passage openings 14, 15, and 16 into the jewelry sections 2, 5, and 9; and (e) a screw 17, which also has a hat 18 and whose shaft 19 provided with an external thread can be screwed into the internal thread of the nut member 13, so that in this manner the jewelry sections 2, 5 and 9 are fastened detachably, as shown in FIGS. 5 and 6.

The receiving openings 3 of the first jewelry section I and the viewing openings 6 of the second jewelry section 5 and the receiving openings 7 of the second jewelry section 5 and the viewing openings 10 of the third jewelry section 9 are designed and arranged in such a manner that in the assembled state of the jewelry sections 2, 5 and 9, in which the same are fastened together detachably by means of the nut 11 and the screw 17 and one gemstone 4 or 8 is set loosely into each of the receiving openings 3 and 7 (see in particular FIG. 5), (1) the gemstones 4, set loosely into the receiving openings 3 of the first jewelry section 2, are visible through the viewing openings 6 of the second jewelry section 5 and thus at least one portion of the border 31 (by which can be understood only one portion of one of the four sides of the respective viewing opening or one web or the like protruding into said opening) of the viewing openings 6 of the second jewelry section 5 rests on one of the gemstones 4 and holds said stone in the respective receiving opening 3 in the first jewelry section 2;

(2) gemstones 8, set loosely into the receiving openings 7 of the second jewelry section 5, are visible through the viewing openings 10 of the third jewelry section 9 and thus at least one portion of the border 20 (by which can also be understood only one portion of one of the four sections of the respective viewing opening or a web or the like projecting into said opening) of the viewing openings 10 of the third jewelry section 9 rests on one of the gemstones 8 and holds it thus in the respective receiving opening 7 of the second jewelry section 5; and (3) all visible openings 6 and 10 are exposed externally, so that all gemstones 4 and 8 are visible to the observer.

As FIGS. 1, 2 and 3 and 5 show, the first jewelry section 2, the second jewelry section 5 and the third jewelry section 9 and the externally visible hat 12 of the nut 11 are designed as pyramidal disks, which in the assembled state form a multistepped pyramidal piece of jewelry 1. The angle $\propto$ (see FIG. 5) between the pyramid center axis 21 and the pyramidal areas 22 of the jewelry article 1 can be selected over a wide range and is chosen preferably in such a manner that the rear sides of the gemstones 4 (or suitable beads), which lie the closest to the rear side of the gemstone (at the bottom in FIG. 5), do not project outwardly beyond the actual basal plane 30.

Figure 2:
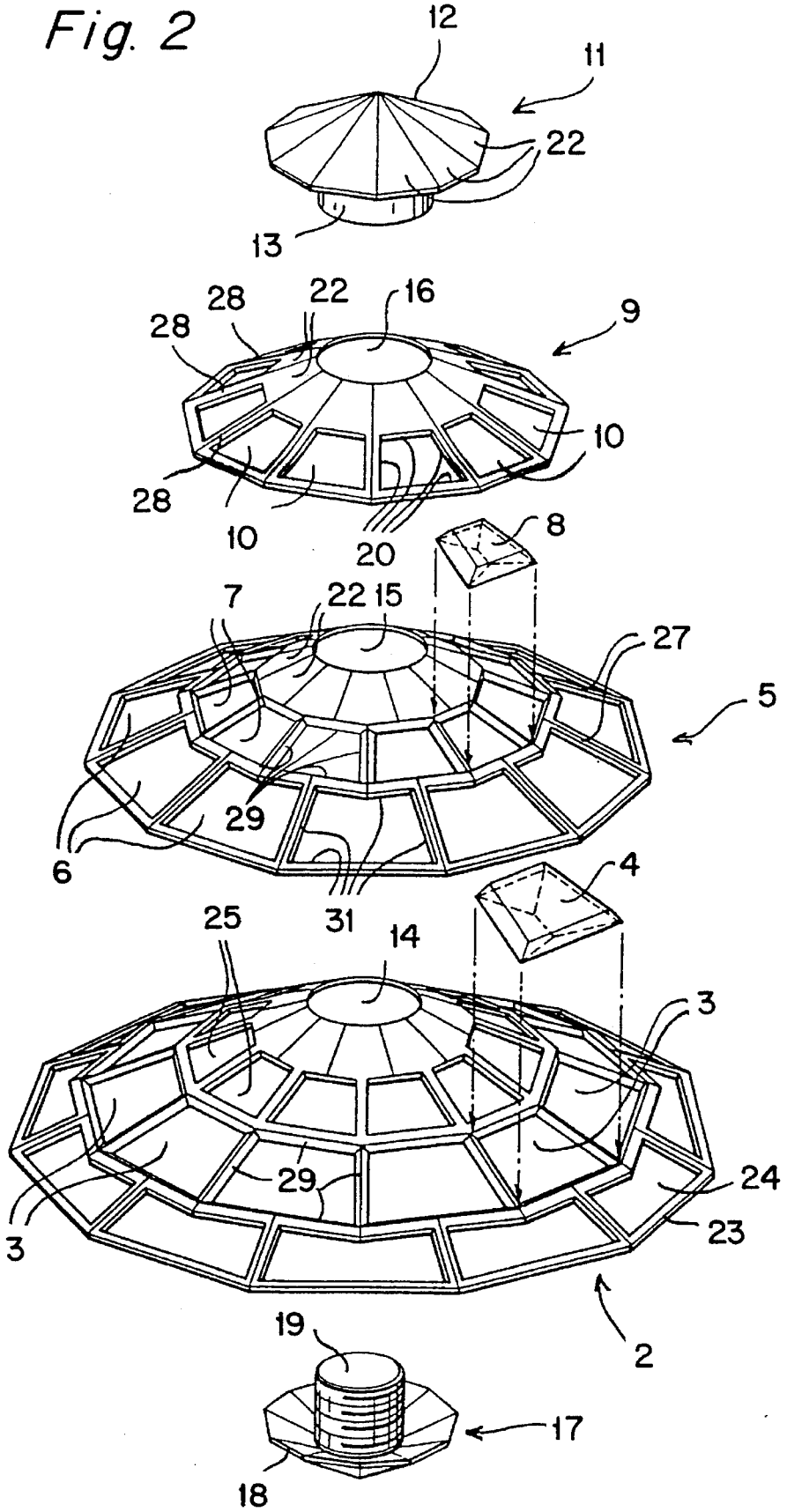
FIG. 2 is an enlarged perspective view of the piece of jewelry shown in FIG. 1 so that the individual elements of the same are visible, whereby for the sake of clarity only two of the many gemstones have been indicated.
Figure 3:
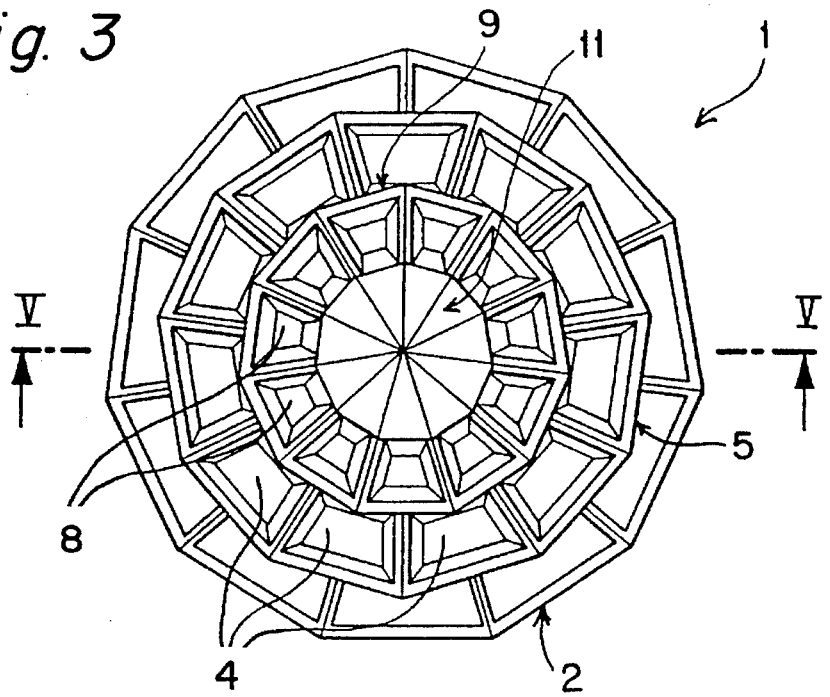
FIG. 3 is a top view from the top of the piece of jewelry of FIG. 1, wherein the receiving openings for the gemstones and the viewing openings are arranged in such a manner relative to each other, that the borders of the viewing openings rest on the side edges of the gemstones located directly underneath.

As FIGS. 1, 2 and 3 also show, the receiving openings 3 and 7 and the corresponding viewing openings 6 and 10 are arranged in strip-shaped regions, which are concentric relative to the pyramid center axis 21, so that they fill in essence a truncated pyramid region that is concentric to the pyramid center axis 21. In addition, the first jewelry section 2 also exhibits the following:

(A) an ornamental lattice 23, whose lattice openings 24 are designed similar to the receiving openings 3 and which continue externally the step-like pyramid formed by the jewelry sections 2, 5 and 9 and the hat 12, in that the ornamental lattice 23 is in the present design an integral component of the pyramidal disk formed by the first jewelry section 2; and (B) free space openings 25, which are arranged radially inwardly from the receiving openings 3 and in the present design have the Purpose of saving material, a state that above all is important in those cases in which the jewelry sections are made of precious metal or precious metal alloy and in which the jewelry is to be made as lightweight as possible for reasons owing to comfortable wearability; these free space openings 25 can, however, also be arranged in such a manner that in the assembled state of the jewelry article 1 they are in essence coincidence with the receiving openings 7, so that the rear sides of the gemstones 8 can be held with play, when the gemstones 8 have a relatively large depth, in particular for reasons owing to a reflection optimizing polish of the same; and the jewelry sections are to be designed relatively thin and/or are to be stacked closely together.

Figure 4:
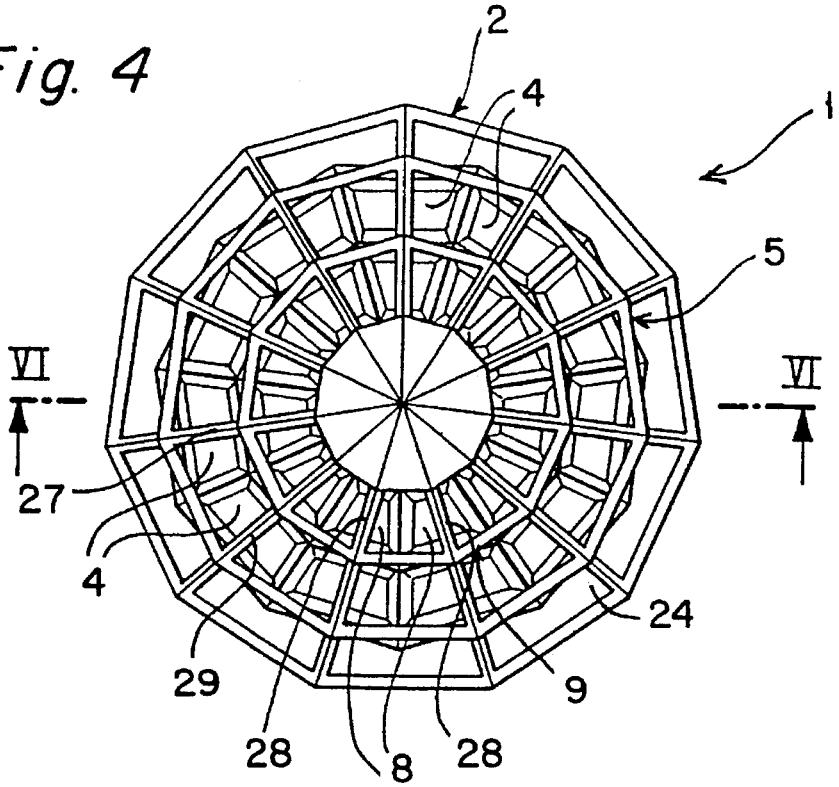
FIG. 4 is a top view from the top of the piece of jewelry of FIGS. 1, 2, and 3, whose state with respect to FIG. 3 has been modified in such a manner that the receiving openings for the gemstones and the viewing openings are arranged in such a manner relative to each other that the webs, which are located between laterally adjacent viewing openings, rest on the center regions of the gemstones situated directly underneath.

As aforementioned, FIGS. 4 and 6 show another embodiment of the jewelry article 1, which is depicted in FIGS. 1, 3 and 5 and in which the jewelry sections 2, 5 and 9 are rotated with respect to each other in such a manner and fastened detachably together that (A) the webs 27 between the adjacent viewing openings 6 of the second jewelry section 5 extend over the central regions of the gemstones 4 located in the receiving openings 3 of the first jewelry section 2; and (B) the webs 28 between the adjacent viewing openings 10 of the third jewelry section 9 extend over the central regions of the gemstones 8 located in the receiving openings 7 of the second jewelry section 5.

The result is thus, as the top view of FIG. 4 shows, an attractive aesthetic shape of the jewelry article, by means of which the webs 27 and 28 are especially emphasized.

It must be pointed out here that a third embodiment (not illustrated) can be formed here from the identical individual sections by suitable rotation in that only either the webs 27 or the webs 28 extend over the central regions of the assigned gemstones 4 or 8, whereas the remaining portion of this jewelry article corresponds to the embodiment of the jewelry article 1 in FIGS. 1, 3 and 5.

Even though in the above embodiment exclusively gemstones are set into the receiving openings, the above description applies correspondingly to the case that all gemstones or a portion of the gemstones are replaced by beads, in which case the receiving openings are designed, as aforementioned, round, instead of rectangular, and in which case the sloped seatings 29, which are provided in the receiving openings 3 and 7 and intended for the gemstones 4 and 8, are replaced preferably by means of seatings, whose cross section is curved and which are adapted to the shape of the beads to be set.

Moreover, the embodiment that is illustrated here and that is constructed from three jewelry sections 2, 5 and 9, whose diameter becomes smaller step-by-step, is only one example, because in the simplest case the jewelry article according to the invention can include in the simplest case (with respect to the jewelry sections) only two jewelry sections 5 and 9, in which case the border members 31 and the webs 27 form, for example, an ornamental lattice; or the jewelry sections 2 and 5, in which case the border members of the receiving openings 7 can form an ornamental lattice, instead of receiving gemstones 8 or in which case the border members 29 form an ornamental lattice and the openings 25 receive gemstones 8 and the openings 7 are designed as viewing openings. And in still other engineered shapes four, five or more jewelry sections can be used to construct the piece of jewelry according to the invention, whereby the individual jewelry sections have preferably a step-by-step decreasing size, such as a step-by-step decreasing diameter, whereby preferably the viewing openings lie in the direction of the edge or at the edge, whereas the receiving openings are located further toward the inside, so that the size, for example the diameter, decreases step-by-step continuously by the area of the viewing openings.

In addition to the shapes, listed above by way of examples, the receiving openings can have varying suitable shapes as a function of the shape of the gemstones or beads, in particular rectangular, square, triangular, tear-shaped and/or oval, whereby the viewing openings are designed to match.

Furthermore, it is within the scope of the invention that gemstones or beads are not set in all receiving openings, but rather selected receiving openings can remain empty for design reasons.

As explained or implied in part already above, jewelry is provided with the invention that enables the exact design at minimum labor and material costs, and in which an exact uniform hold of the gemstones and/or beads is guaranteed by means of the method according to the invention.

Even if the invention was explained in the above description with reference to a pyramidal jewelry article with circular or polygonal outline, it is clear that the jewelry article according to the invention can be designed in different geometric shapes. For example, the jewelry according to the invention can be also rectangular or square, for example, bent into a clasp, which can be worn around the neck, arm or finger. Or the jewelry article can have an irregular outline, such as a leaf-shaped or fan-shaped outline derived from nature. In all cases it is clear that the jewelry article can be both two-layered (two stacked jewelry sections) and also multilayered (more than two stacked jewelry sections), in particular for example terrace-shaped or in the broadest sense pyramid-shaped, with varying basal planes.

Furthermore, it must be pointed out that the design of the jewelry article made of sections that are concave in the direction of its interior, in particular concave shells, such as forming a pyramidal shape, is especially advantageous, because in an especially thin design of said jewelry sections the thickness of the gemstones can thus be integrated in the interior of the jewelry article, thus resulting in a light-weight jewelry article that is comfortable to wear and feels good to the touch.

In the conical, truncated, pyramidal or truncated pyramidal jewelry articles that are described above and shown in FIGS. 1 to 6, the nut 11 and the screw 17 are only a preferred embodiment of a central, detachable connection, with which all of the jewelry sections including the gemstones or beads or the like are held together. Other embodiments of such a central detachable connection are, e.g. a bayonet connection, a snap-in connection, a lock-in connection or the like. In other jewelry articles of the invention, in particular other conical, truncated, pyramidal, or truncated pyramidal jewelry articles of the invention, a detachable central connection in the above sense can also be provided than the one illustrated and/or described. In place of only one central detachable connection, several detachable connections of the aforementioned kind can also be provided.

Moreover, in other preferred embodiments of the piece of jewelry according to the invention a detachable central connection or several detachable connections in the aforementioned sense can be provided in an extremely advantageous manner, that are characterized in that they exhibit jewelry sections corresponding to jewelry sections 2, 5 and/or 9, but unlike these are not conical, truncated, pyramidal or truncated pyrmidal, but rather are in general roof-shaped, closed on the side or open on the side, have, for example a cross section as shown in FIGS. 5 and 6, if the central axis of symmetry 21 is replaced by a plane of symmetry, which extends perpendicular to the drawing plane and whose cut line with the drawing plane is represented by the line 21. The result is a steep roof-shaped piece of jewelry, which exhibits the invention and has at least two stacked, roof-shaped jewelry sections along functional lines—i.e. with respect to the setting of the gemstones, beads or the like—of the jewelry sections 2, 5 and/or 9, but can also include several such jewelry sections, thus can form to some degree a multi-stepped roof—similar to the multi-stepped pyramids.

However, a roof-shaped piece of jewelry according to the invention is not restricted to a simple steep roof shape, but rather can be assembled from several roof shapes, for example steep roof shapes, which cross, collide at an angle, proceed in the shape of a star from a central point and thus can have identical or different lengths.

Thus, the steep roof shape is only one example of a roof shape, since the piece of jewelry according to the invention can also have varying different roof shapes whose design is simple or assembled, in particular roof shapes whose legs are non-uniform, such as a shed roof shape. In addition, the cross section of the roof surfaces can be curved, such as pagoda roofs, semicircular vaulted roofs, etc.

Insofar as all of these roof-shaped jewelry articles of the invention have flat roof shapes, what they have in common is that the angle $\propto$ (see FIG. 5 under the above condition that the line 21 represents there the cutline of a plane of symmetry that is perpendicular to the drawing plane) between at least two roof-shaped surfaces of a roof-shaped jewelry section is larger than 0° and smaller than 360° and has preferably such a size that no jewelry sections, beads or the like project externally beyond the actual basal plane of the jewelry article. In the case of curved roof surfaces and parts that are in general concave in the direction of the interior of the piece of jewelry, in particular concave shells, the concavity is chosen preferably in such a manner that no gemstones, beads or the like project externally beyond the actual basal plane of the jewelry article, thus are located totally within the piece of jewelry.

Even for roof-shaped jewelry articles and the aforementioned parts that are concave in the direction of the interior of the jewelry article, in particular shells, the detachable connection or several detachable connections can have jointly a "hat", which covers the roof ridge or an outer region of the jewelry article and whose cross section corresponds to the concave parts, in particular shells, as the upper confining flange for the jewelry sections, which corresponds to the hat 12 of the embodiments described above and—as in the embodiments of FIGS. 1 to 6—becomes an integrated piece of the jewelry article, so that from the outside it looks in an extremely advantageous manner as if it did not have at all a detachable connection. The uppermost jewelry section can also form this "hat" in that the one member of one or several detachable connection(s) is fastened towards the inside of the jewelry article.

The jewelry articles, constructed from sections that are concave in the direction of the interior of the piece of jewelry, such as the simple roof-shaped jewelry or jewelry, which is assembled from several roof shapes (see above) and exhibits the invention, and the conical, truncated, pyramidal, or truncated pyramidal jewelry according to the invention are especially preferred, because they can be designed in such a manner—as illustrated—that the gemstones, beads or the like do not project beyond the actual basal plane of the piece of jewelry; i.e., their rear side is integrated into the interior of the piece of jewelry, and because the gemstones, beads or the like can be set with minimum material thickness, e.g. sheet metal thickness, of the jewelry sections, and an extremely high concentration of gemstones or beads is achieved at a minimum setting cost. In so doing, the gemstones, beads, or the like can be replaced, as explained above, with additional gemstones, beads or the like, so that there are no limits to one's fantasy.

Thus, the jewelry sections can be in particular generally convex toward the outside or concave toward the inside, of which the pyramidal shapes, truncated shapes and roof shapes are strictly geometric examples. However, other shapes, for example natural shapes such as a leaf shape and shapes interpreted with a sensitive artistic understanding, can be selected that are also designed convex outwardly or concave inwardly.

In addition, the gemstones or beads are provided preferably as spacers between the jewelry sections.

Even though in the above the modification of the visual appearance of the jewelry with respect to conical, truncated, pyramidal or truncated pyramidal jewelry is achieved by rotating the jewelry sections in opposite directions around the center axis, a process that can take place in general with jewelry that is centrally symmetrical around a center axis, the invention is not at all restricted thereto. Thus, in other jewelry articles, such as jewelry with more general shapes like stylized leaf shapes, the shape based on the arrangement of the webs of the lattice-shaped jewelry pattern between laterally adjacent viewing openings on the central regions of the gemstones or beads can be modified by moving the jewelry sections in opposite directions, so that the detachable fastening(s) has/have several fastening positions, in which jewelry sections are shifted in opposite directions in the above sense. Another solution of the invention for the purpose of arranging by choice the aforementioned webs in one and the same piece of jewelry around the edges of the gemstones or on their central regions, comprises in the case of mirror symmetrical jewelry sections, e.g. those comprising ellipsoid concave shells, of arranging differently the gemstones and webs of both mirror symmetrical halves in such a manner, e.g. non-symmetrically (which can be quite attractive for a piece of jewelry) that in the two possible positions (rotated by 180°) of an ellipsoidal concave shell, on the one hand, the webs rest on the edges and, on the other hand, rest on the central regions of the gemstones (the same applies to beads, instead of gemstones).

I claim:

1. Jewelry comprising:

gemstones or beads;

a first jewelry section which comprises receiving openings for the loose setting of said gemstones or beads; and a second jewelry section detachably mounted upon said first jewelry section and comprising viewing openings extending completely through said second jewelry section, said viewing openings being separated from one another by web portions of said second jewelry section, said receiving openings and said viewing openings arranged such that:

gemstones or beads set into said receiving openings are visible through said viewing openings, and portions of said second jewelry section rest on said gemstones or beads to fix said gemstones or beads in said receiving openings;

wherein said first and second jewelry sections are adjustable relative to one another between different fixing positions such that a positional relationship between said web portions and said receiving openings, as viewed in a direction through said viewing openings, is changeable.

2. Jewelry, as claimed in claim 1, wherein in one of said different fixing positions at least some of said web portions rest upon side edges of respective gemstones or beads, and in another of said different fixing positions said at least some web portions rest upon portions of respective gemstones or beads disposed between said side edges thereof.

3. Jewelry, as claimed in claim 2, wherein in said one fixing position all of said web portions rest upon side edges of a respective gemstones or beads.

4. Jewelry, as claimed in claim 2, wherein in said another fixing position all of said web portions are situated centrally between side edges of respective gemstones or beads.

5. Jewelry, as claimed in claim 1, wherein said second jewelry section exhibits receiving openings for the loose setting of additional gemstones or beads, and further comprising a third jewelry section mounted detachably upon said second jewelry section, said third jewelry section exhibiting viewing openings separated from one another by web portions of said third jewelry section, wherein said additional gemstones or beads set into said receiving openings of said second jewelry section are visible through said viewing openings of said third jewelry section; portions of said third jewelry section being arranged to rest upon respective ones of said additional gemstones or beads disposed in said receiving openings of said second jewelry section.

6. Jewelry, as claimed in claim 5, wherein said second and third jewelry sections are adjustable relative to one another between different fixing positions such that the positional relationship between said web portions of said third jewelry section and said receiving openings of said second jewelry section, as viewed in a direction through said receiving openings of said second jewelry section, is changeable.

7. Jewelry, as claimed in claim 1, wherein said receiving openings extend completely through said first jewelry section.

8. Jewelry, as claimed in claim 1 further including a fastener interconnecting said first and second jewelry sections for relative rotation about an axis to adjust said first and second jewelry sections relative to one another.

9. Jewelry, as claimed in claim 1, wherein each of said first and second jewelry sections has a concave side and a convex side, said concave side of said second jewelry section resting upon said convex side of said first jewelry section.

10. Jewelry, according to claim 9, wherein said receiving openings extend completely through said first jewelry section, said gemstones or beads projecting from opposite ends of said receiving openings and being spaced from a plane defined by an outer periphery of said first jewelry section.

11. Jewelry, according to claim 1, wherein said first and second jewelry sections are rotatable relative to one another about an axis, each of said first and second jewelry sections being symmetrically configured with respect to said axis.

12. Jewelry, according to claim 11, wherein said receiving openings are arranged around said axis.

13. Jewelry, as claimed in claim 1, wherein said second jewelry section includes a lattice configuration defining said viewing openings.

* * * * *